United States Patent [19]

David

[11] Patent Number: 4,660,857

[45] Date of Patent: Apr. 28, 1987

[54] PROTECTOR FOR PUBLICATION AND METHOD FOR GUARDING A SELECTED PORTION THEREOF

[76] Inventor: Constant V. David, 4952 Field St., San Diego, Calif. 92110

[21] Appl. No.: 907,151

[22] Filed: Sep. 12, 1986

Related U.S. Application Data

[63] Continuation-in-part of Ser. No. 711,288, Mar. 13, 1985, abandoned.

[51] Int. Cl.[4] ..... B42D 5/00; B65B 51/04; B65B 5/00

[52] U.S. Cl. ..... 281/20; 53/419; 53/467

[58] Field of Search ..... 281/20; 53/419, 467, 53/499, 399

[56] References Cited

U.S. PATENT DOCUMENTS

| | | | |
|---|---|---|---|
| 169,536 | 11/1875 | Glover | 281/20 |
| 658,666 | 9/1900 | Mahony | 281/20 |
| 1,726,684 | 9/1929 | Sollom | 281/20 |
| 2,657,072 | 10/1953 | Harrington | 281/20 |
| 2,675,123 | 4/1954 | Baird | 53/419 |
| 2,774,615 | 12/1956 | Joseph | 281/20 |
| 3,040,473 | 6/1962 | Wetzler | 53/419 |
| 4,373,300 | 2/1983 | Partridge | 53/467 |

FOREIGN PATENT DOCUMENTS

| | | | |
|---|---|---|---|
| 629588 | 12/1961 | Italy | 281/20 |
| 270395 | 5/1927 | United Kingdom | 281/20 |

*Primary Examiner*—Paul A. Bell
*Assistant Examiner*—Paul M. Heyrana, Sr.

[57] ABSTRACT

Apparatus and method for packaging, guarding and sealing a portion of a publication. The pages of the publication contained in the portion thus packaged, guarded and sealed are prevented from being viewed until and unless a seal is broken, at which time these pages and/or content can then be freely viewed. The cover, pages and content of the other portions of the publication which are not so protected, packaged, guarded and sealed are permitted to be viewed as though the protecting apparatus guarding the sealed off portion of the publication were not present. The apparatus and the method can be used with publications of varied sizes and for guarding portions of the publication which may contain various amounts of pages, as required and as deemed appropriate at the time the publication whole content is assembled for binding. Once the seal has been broken, it is made impossible to replace it without leaving evidence and/or proof that the protector has been tampered with and that the content of the sealed portion has therefore been viewed.

6 Claims, 3 Drawing Figures

Fig. 1
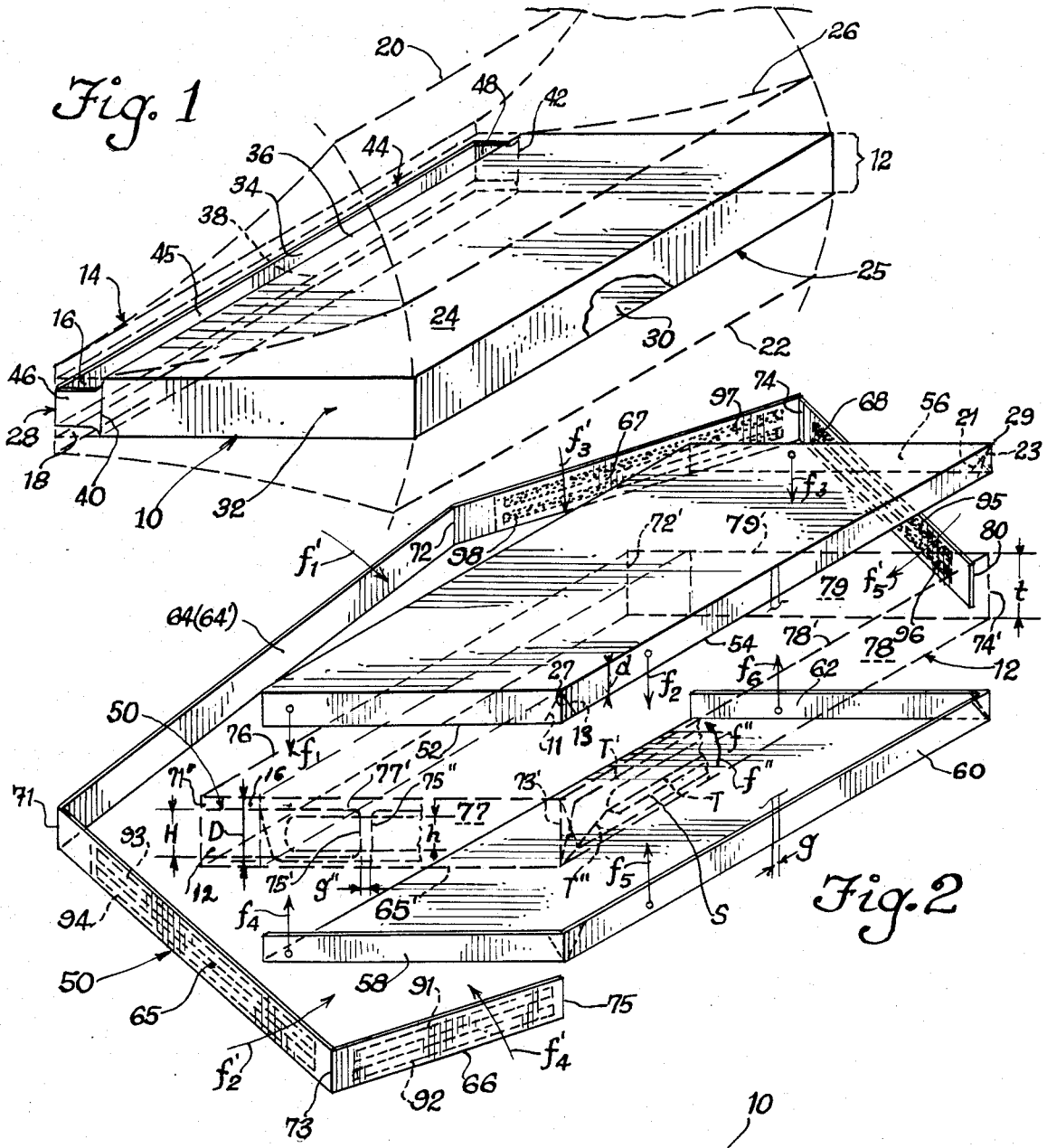
Fig. 2
Fig. 3
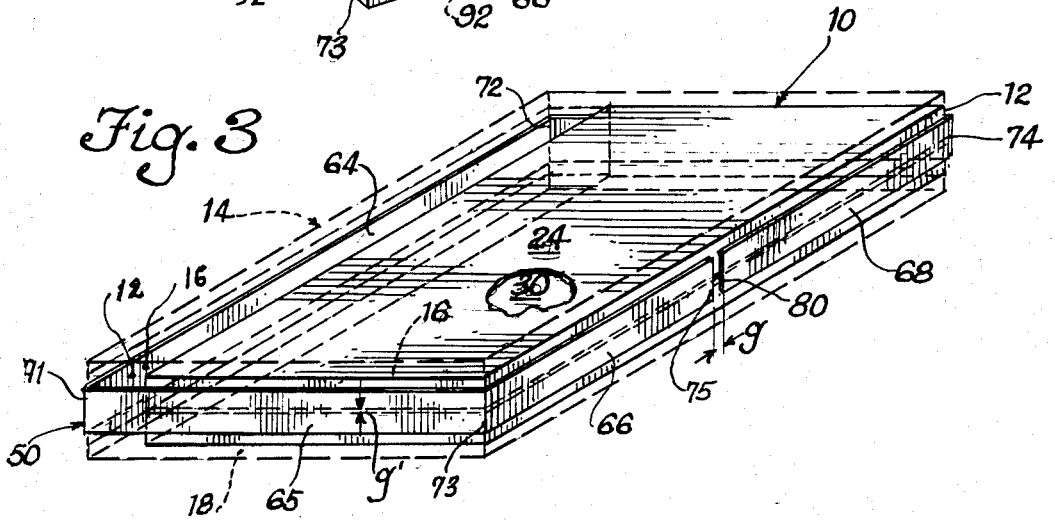

PROTECTOR FOR PUBLICATION AND METHOD FOR GUARDING A SELECTED PORTION THEREOF

This application is a continuation-in-part of Ser. No. 711,288, filed Mar. 13, 1985, now abandoned.

BACKGROUND OF THE INVENTION

1. Field of the Invention

The present invention generally relates to protecting, guarding and sealing a selected portion of a publication and, more particularly, is concerned with apparatus and method for providing such a guard and seal so that the content of the publication thus guarded and sealed cannot be viewed without first removing the guard by breaking the sealing part of the protector.

2. Description of the Prior Art

For many years, books, booklets, magazines and various other forms of printed materials and/or publications have been packaged in a manner such that the whole of the publication is enclosed inside the protective packaging envelope which may consist of a paper jacket, a closely fitting plastic wrapping, various forms of bands wrapped around the publication in either direction, the latter being kept flat, made into a tubular shape or, in some instances folded. If the wrapping is made of clean, transparent plastic, the contents of only the external surfaces of the front and back covers are visible and made viewable and/or readable. If the wrapping protects most of the cover areas and is not rendered transparent, even the content of the external surfaces of the front and back covers cannot be viewwed without first breaking and/or removing the wrapping. If a viewing window is cut in the wrapping or made transparent, only small sections of the external surfaces of the front and back covers are revealed for examination by potential purchasers.

Two main methods are extensively used for marketing printed material to the public on the "sampling" approach: (1) the first is based on exposing the material to the public viewing for a quick on-the-spot evaluation of the publication content, which is supposed to adequately motivate impulse buyers; and (2) the second is based on making the material available to potential purchasers for review and evaluation during a specified limited period of time, usually including a "satisfaction guaranteed or money back" contractual clause to which the potential purchaser has somehow tacitly agreed. Practically, such a clause constitutes solely a sales gimmick and is seldom used properly and legitimately by either of the parties who may later assume adverse positions in a dispute. Both marketing methods have serious drawbacks. The first invites undesirable loafers to stand around magazine racks and/or book displays reading the material without buying, the second contains built-in sources of difficulties that may lead to dissatisfaction, resentment, frustration and/or unpleasant experiences, time and money lost, and generally a mistrust of the "full satisfaction or money back" approach to publication promoting. This mistrust eliminates the possibility of many genuine sales that otherwise could be made and may hamper the success of such promotion efforts.

Consequently, a need exists for improvements in the presentation approach used to expose printed material to the public in a manner such that: (1) enough publication printed material is made readily accessible to potential buyers, for review and evaluation prior to purchasing; and (2) a simple inexpensive physical means is available for providing unequivocally and unambiguously whether the whole of the publication has or has not been viewed in its entirety.

SUMMARY OF THE INVENTION

The present invention provides an apparatus and method designed to satisfy the aformentioned needs. A selected portion of a publication is protected and guarded by a protective sheath or enclosure which can only be removed if and when the member which holds the enclosure in place is broken, thus acting as a seal. The pages and content thereof of the portion of the publication assembled inside such enclosure cannot be viewed, being protected and hidden. However, the covers and pages of the publication located outside the enclosure remain fully accessible and may be viewed as they would otherwise be without the presence of the protector. The protective guard can be used in conjunction with any other standard manners or usage of wrapping and/or protective packaging means.

Accordingly, it is an object of the present invention to provide a new and improved apparatus and method for selectively guarding, sealing and generally preventing from viewing a portion of a publication, preselected by the publisher.

It is another object of this invention to provide a protector which does not prevent and does not interfere with the viewing of those other portions of the publication which the publisher wishes to leave accessible to potential purchasers for prepurchasing review and evaluation.

It is further another object of this invention to permit the concurrent usage of other forms of standard packaging and wrapping with the use of the publication protector of the invention then positioned internally to the standard packaging envelope.

It is still another object of this invention to provide a simple, easily breakable sealing member that cannot be replaced and/or tampered with, without revealing the convincing positive proof of such tampering.

Other objects and many advantages of this invention will become more apparent upon reading of the following detailed description and an examination of the drawings wherein like reference numbers designate like parts throughout.

BRIEF DESCRIPTION OF THE DRAWINGS

FIG. 1 is a schematical perspective view of a protective enclosure shown inserted in the body of the publication for protecting a portion thereof.

FIG. 2 is a blown schematical perspective view of the four basic components of the invention preferred embodiment, shown in their relative positions with respect to the publication portion to be guarded, prior to the completion of the enclosure assembly around the publication portion to be sealed.

FIG. 3 is a schematical perspective view of an assembled enclosure shown protecting the sealed publication portion represented assembled with and inserted between two remaining unguarded portions of the publication shown all assembled together in the form assumed by the whole of the publication.

DESCRIPTION OF THE PREFERRED EMBODIEMENT(S)

Figure 4:
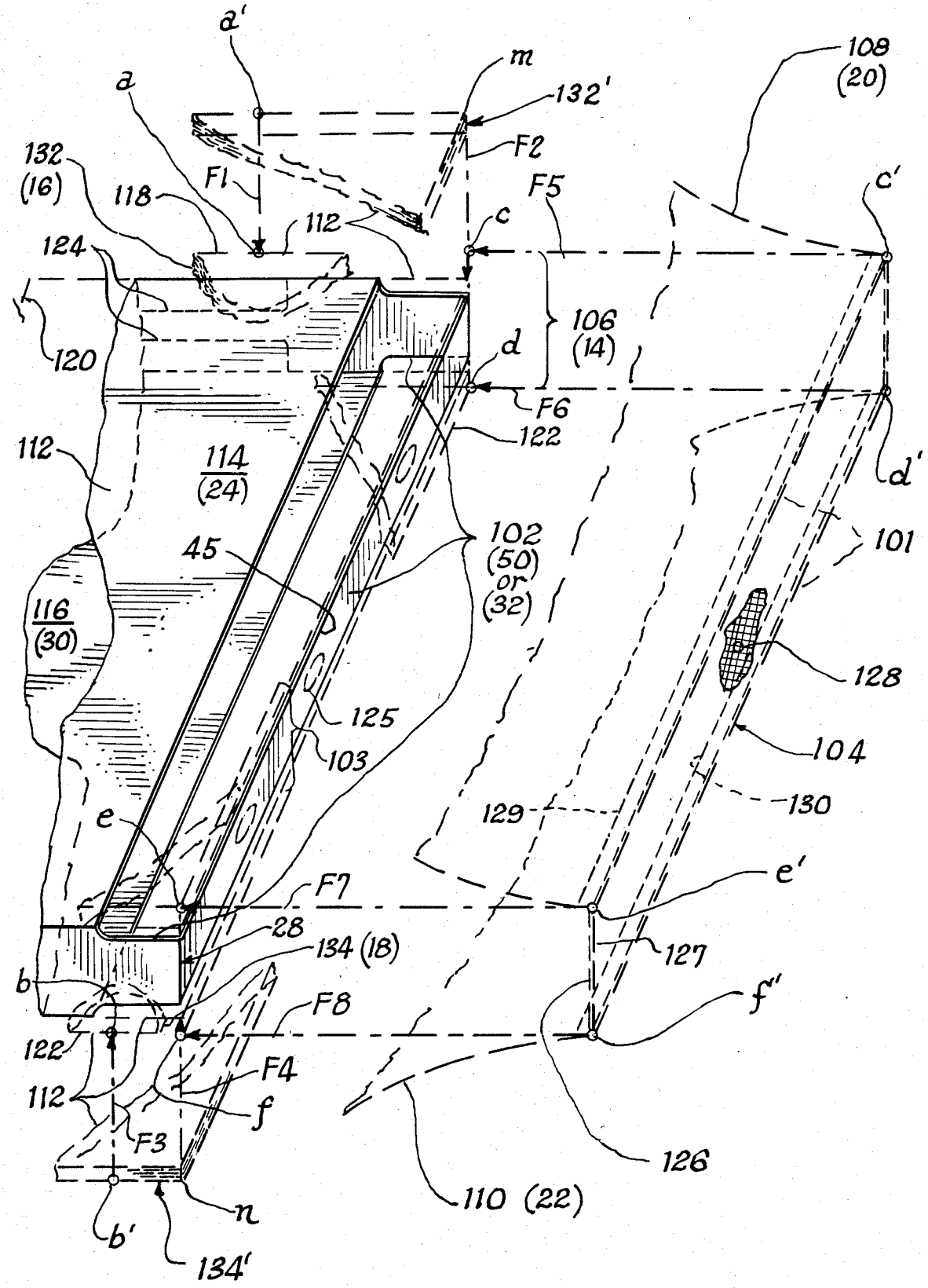

Referring now to the drawings, and more particularly to FIG. 1, there is schematically shown apparatus, generally designated 10 for protecting, guarding and sealing a portion 12 of the publication 14, the outline of which is shown in phantom lines for the sake of clarity. The publication contains two unguarded portions 16 and 18 located in front of and behind the sealed portion, respectively. Front cover 20 and back cover 22 are represented slightly open. Between front cover 20 and front face 24 of enclosure assembly 25, a single page 26 is represented slightly ajar and open, thusly exampling the accessibility of those portions and pages of the publication that are located externally to the sealed portion. Publication 14 is represented typically as a paperback book having a spine 28. The protector assembly 10 includes four basic components or members which together form the body of the apparatus. These components include front face 24 aforementioned, back face 30, enclosing strip 32 which forms loop 34 located behind or that may be made part of spine 28. Front face 24 and back face 30 have free edges 36 and 38 respectively. These edges are positioned a small distance from the publication spine, but closely enough so as to make it impossible to free the top and/or bottom pages of the enclosed portion from the completed enclosure. The other three edges of the front and back faces are positioned flush with the edges of the publication pages. Enclosing strip 32 is constructed to be part of and attached to faces 24 and 30 along those edges which the faces and the strip commonly share. Past two reference lines 40 and 42, strip 32 may narrow somewhat to form a free loop section 44 including back band section 45 and the two short band sections 46 and 48. Depending upon the construction method used for assembling the various portions of the publication, back band section 45 may be made part of the publication spine or be freely positioned behind the said spine.

In the preferred embodiment of the apparatus 10 shown in the process of being constructed around publication portion 12, in FIG. 2, the means for connecting strip 32 to the front and back faces of the enclosure is preferably represented by a preformed and preshaped band 50 which can make surface contacts with tabs 52, 54 and 56 of front face 24, and tabs 58, 60 and 62 of back face 30. These tabs are structurally integral parts of the faces and can be considered appendages thereof. Band 50 typically includes five sections 64, 65, 66, 67 and 68 forming prebent corners 71,72, 73 and 74 which are positioned along the length of band 50 to cooperate with the corners 71', 72', 73' and 74' of the publication portion 12 to be sealed, when band 50 is caused to wrap around the sides 76, 77, 78 and 79 of publication portion 12. The sum of the lengths of band sections 66 and 68 is slightly shorter than the length of band section 64 and/or the height of the pages contained in publication portion 12, so as to leave a narrow gap between the end edges 75 and 80 of band 50 when the latter has become attached to the six tabs of insert faces 24 and 30. Arrows $f_1$ to $f_6$ indicate how the insert faces and their tabs come together to enclose publication portion 12 when the insert faces are pushed against publcation portion 12. Arrows $f_1'$–$f_5'$ indicate how the sections of band 50 move against sides 76–79 of portion 12 when proper pressures are applied to close gap g made by end sections 66 and 68 of band 50. Narrow strips are coated with pressure sensitive adhesive and are located as shown in FIG. 2 to match correspondingly centered strip sections on the tabs of insert faces 24 and 30. The locations on the tabs where the coated strips of band 50 make contacts are not shown for the sake of simplicity. The coated strips 91 to 98 are deposited on the surfaces of band 50 sections 66, 65, 68 and 67 which are to become internally oriented when band 50 is caused to close gap g. At that time, as soon as the coated strips establish the contacts with the cooperating tabs, the enclosure around publication portion 12 is completed and portion 12 is enclosed and sealed, ready for assembling with the other portions of the publication.

If insert faces 24 and 30, and their appended tabs are cut from a flat sheet, the tabs are bent to form right angle corners with the flat surfaces of insert faces 24 and 30, thus forming the one half of the guarding enclosure. In this instance, contiguous tabs need not come in contact with one another, when they are bent and can be cut at skewed angles as represented by phantom lines 11, 13, 21, and 23. Corners 27 and 29 are missing in this case, and are not needed.

Referring now to FIG. 3, schematically represented is an assembled publication illustrated in phantom lines which includes the sealed enclosure formed with the basic components or members described above. The assembled enclosure is show in solid lines for clearer identification. The sizes of gap g left open between the two ends of band 50 and of gap g' located between the ends of insert face 24 tabs and those of insert face 30 tabs, indicate how tight and complete are the enclosing and sealing of the publication portion to be guarded and how well protected it is from idle curiosity. For better illustration purpose, in FIGS. 2 and 3, the tabs and band 50 have been given an appreciable thickness which is reaily shown out of proportion, but serves to make these parts stand out in the illustrations.

DISCUSSION

The embodiment depicted in FIGS. 2 and 3 is only one example of a straightforward way to construct the enclosure shown in FIG. 1. This preferred construction mode of the embodiment of the present invention is used for exampling the practicality and the fabrication simplicity of the enclosure, of its wrapping around the publication portion to be guarded and of its handling during the binding of the assembled portions of the publication. The binding fabrication steps of the assembled portions are well known in the art and are not illustrated, being easily describable with words. The handling of the binding, however, justifies some further discussion.

In the case of some publications, it is desirable to make section 64 of band 50 part of the spine of the publication, which is formed during the binding operation (case of a paperback or soft covers). This is especially true in the case of thin publications, such as magazines, booklets and/or tabloids. In the case of thick paperback books or of hard cover books, it may be desirable to keep section 64 of band 50 free from and apart of the book spine. The assembling sequence of band 50 with insert faces 24 and 30 is different between these two typical cases. The case where section 64 of band 50 is to become part of the spine during the binding operation is fully described in the previous section. The other case is described below.

When it is desirable to keep section 64 of band 50 free (e.g. case of a thick paperback book), the order in which the steps of the assembling of the publication proceed is as follows: (1) insert faces 24 and 30 with their tabs already bent in shape are assembled around portion 12 of the publication; (2) this portion is then assembled with the other portions (possibly some guarded, some not, as scheduled) of the publication; (3) the assembled portions are then bound as they would otherwise have been had the insert faces not been present (publication with no guarded portion); (4) preformed and precoated band 50 is positioned at the correct height around the assembled publication in a manner such that contacts between the coated strips of band 50 and the tabs are later made in the right spots; and (5) the proper pressures, in the required amount and in the correct sequence, are then applied on the various sections of band 50, so that the enclosure becomes completed. Section 64 of band 50 is thus necessarily automaticaly positioned outside of the publication spine and not made part thereof. Publication portion 12 is then sealed and forever guarded, until and unless the free loop of band 50 is broken, which then allows insert faces 24 and 30, and the sections of band 50 still connected and attached to them, to be pulled out, thereby liberating and unsealing portion 12, making it accessible for viewing and leaving proof of tampering behind.

Another preferred construction of the enclosure is briefly and schematically presented in FIG. 2, in phantom lines. It corresponds to an alternate fabrication approach to forming the protective sealing guard. The tabs appended to insert faces 24 and 30 extend farther out (for a same thickness of portion 12) than shown for the previous construction mode already described. The depth d reached by the previous configuration tabs is made larger and becomes D, where D is almost as large as t, which is the thickness of portion 12 of the publication. Previously, the value 2d was slightly less than the value of t, whereas, in the now discussed tab configuration, D is roughly as large as 2d. The tabs of one insert face (24 in the case shown in FIG. 2) are bent at a 90° angle. The tabs of the other facing insert (30 in the case shown of FIG. 2) are bent to a lesser degree, as illustrated by tab T shown in its open (prebonded) position, but which assumes position T′ when the enclosure is completed. As is depicted in FIG. 2, tab T overlaps corresponding and cooperating tab T″ of the opposite facing insert face already bent to shape, when pressure is applied onto tab T in a direction such that tab T bends farther in the direction of arrow f″. Either the external surfaces of tabs such as T″ and/or the internal surfaces of tabs such as T (T′) are coated with pressure sensitive adhesive along strips outlined by phantom line S. If both tabs have strips coated with one different part of a two-part adhesive bonding agent, each one remaining not tacky until they make physical contact, the handling of the unassembled enclosure members is rendered much safer and easier. One set of tabs is thus coated with one adhesive part, the other set of cooperating tabs being coated with the other complementary adhesive part. The bonding takes place when both set of tabs are forced together by applying pressure, and possibly with moderate heating being also applied. These actions trigger the chemical reactions between the two adhesive parts and which are required for creating the bond. Such materials and techniques are well known in the art and require no further elaboration.

In the latter instance, band 50 needs not form a full loop around the publication. Sections 66 and 68 are not needed, and sections 65 and 57 can be shortened to the extent that the ends 75′ and 80′ of the shortened band 50 (referred to now as 50′) of width H barely reach the sides edges 75″ of shortened tabs such as 65′. The end portions of band 50′ may be adhesive-coated internally, or the adhesive present on one tab surface, left uncovered by the shortening of its cooperating tab, can be used to form the required bond between insert face 24 side tabs and band 50′, thus completing the enclosure. If a two-part adhesive is used, the internal surfaces of the end sections of band 50′ may then be coated with the complementary adhesive part. The shortening of the length of the tabs of the set of side tabs which envelop their corresponding cooperating side tabs appended to the opposite insert face creates a gap g″ between edges 75′ and 75″. Band 50′ is bonded to only one of the insert face, that which has its tabs prebent 90°. The use of tab bonding, prior to the completion of the enclosure (band 50′ not yet in place), facilitates the handling of guarded portion 12 during the assembly and binding operations of the various portions of the publication together, in the case where section 64′ of band 50′ (was also referred to as 64 of band 50) is added after the binding operation (free loop case). In such an instance, portion 12 and insert faces 24 and 30 form a self-holding preassembly (or subassembly) which needs no special care during handling, prior to binding. In the case where section 64′ of band 50′ is made part of the publication spine, nothing needs be changed and/or added to what has earlier been discussed.

In all instances and for both enclosure configurations and/or construction modes described and discussed above, loops 64 (or 64′) of band 50 (or 50′) are made of a material that does not stretch. There is no possibility that one could pull either loop 64 (or 64′) over the edge of the spine of the publication, even in the case where the loop is not made part of the spine. If it is, the loop cannot be moved, only broken. However, for flexible thin magazines, a free loop could easily be slipped over the spine. In such instances, the loop should be incorporated into the publication spine. For paperback books, if of normal thickness or thicker, loop 64 or 64′ of band 50 or 50′ (as the case may be), cannot be stretched around one corner of the book spine without damaging the loop beyond repair. For thin hard cover publications, loop 64 or 64′ of band 50 or 50′ could (and should) be positioned between the publication spine and its back side, thereby locking it in place. The type of enclosure construction described and discussed hereinabove is thus adaptable to any sizes and configurations of most current publications. The sealing method of such type of enclosure is positive and reliable.

OPERATION AND USE OF THE INVENTION

As discussed in the two previous sections, the enclosure, with its band loop properly positioned and in place, cannot be removed, much less repaired and replaced later, without causing unequivocal and unambiguous traces of damage to the enclosure band. Such evidence of damage constitutes the prima facie proof that the sealing member has been broken and/or tampered with, and that the sealed portion of the publication may have been viewed. In such an occurrence, the publication so affected must then afterward be considered used, or second hand.

As briefly mentioned in the description of the prior art, a need exists for preventing: (1) the viewing of the whole content of some publications by loafers and/or some segments of the public; (2) the public from having uncontrolled access to the whole content of a publication for free, which often leaves the publication somewhat damaged and/or less desirable and/or less valuable; and (3) arguments between seller and buyer arising from the fact that neither party is provided with the means for proving unequivocally his (her) good faith. However, there is also a need of means for providing free and easy access to part of the content of a publication so that a potential purchaser is given the possibility to assess the value that a publication may represent for him (her), before the final commitment to an unredeemable purchase is made. The latter applies equally well to both bookstore and mail-order types of purchasing.

Especially in the case of mail order buying, it is in the interest of the publisher to provide the potential purchaser with the maximum of information regarding the publication, and its content, that is being offered, but not to permit that potential purchaser full uncontrolled access to the whole content of the publication at his (her) own leisure, without first finalizing the purchase, without future recourse. Otherwise, by then, the potential buyer's motivation for buying is greatly diminished. Then and there, the potential for arguments is generated and often arises: "why should I buy it now?", thinks the reluctant buyer; "you have read it, now pay!", thinks the seller. Genuinely, both could be both equally right and wrong, all at the same time. Thus the feelings felt by both parties of throwing the publication at each other to resolve the conflict can easily be understood and appreciated by those of us who have experienced such frustrations.

The use of the present invention can serve to undisputedly provide the means for and/or establish that: (1) the buyer has not had access to the guarded and sealed portion of the publication, thus is entitled to his (her) refund; (2) the seller gets back a publication which can still be considered new and not second hand (seal unbroken); (3) the buyer had a chance to review and evaluate the publication as to the potential value that it may represent to him (her), and was not falsely misled; (4) the buyer is given the undisputable right to a refund, if he (she) has not broken the seal; (5) promoting a publication without fear and the need of an ambiguous and equivocal contract clause which cannot easily and undisputedly be legally enforced, and in a more legitimate manner; and (6) reassuring the potential buyers that they will not easily fall preys to unscrupulous publication promoters, whose intentions always seem questionable at best and to be solely directed to making a sale at any cost, often under false pretense.

The use of the publication protector permits the potential buyer full access to those portions of the publications which divulge enough facts and information regarding the style, subject and general content of the publication for guiding his or her decision about finalizing the purchase. If and when such potential purchaser has made the decision to buy the publication, it is done with the maximum possible knowledge of that information which the publisher felt free to divulge without compromising the chance of a sale. The end results cannot be perfect and seem always ideal to both parties, but the present invention represents a major step in that direction. The potential buyer then breaks the band, thus the sealing member, removes the enclosure and has stepped beyond the point of no return, but with full appreciation of the facts. The band can be designed to preferentially break as is well known in the art of making such seals.

It is thought that the publication protector apparatus and method of the present invention and many of its attendant advantages will be understood from the foregoing description and it will be apparent that various changes may be made in the form, construction and arrangement of the parts thereof without departing from the spirit and scope of the invention or sacrificing any or all of its material advantages, the form hereinbefore described being merely a preferred or examplary embodiment thereof.

Having thus described my invention, I now claim:

1. A protector for a rectangular publication having a front cover, a back cover, a plurality of pages between the covers, a spine connecting the rearward edges of the covers and pages, a front edge surface opposing the spine and made up of the front edges of the pages, a top edge surface made up of the top edges of the pages and a bottom edge surface made up of the bottom edges of the pages, comprising:

a front face and a back face, the faces each having an area sufficient so that they can overlap a corresponding page of the publication to thereby conceal printed or other information thereon;

a band dimensioned for extending along substantially the entire lengths of the spine, top edge surface, front edge surface and bottom edge surface in overlying relationship therewith; and means for attaching the band to the front and back faces after they have been inserted into the publication in overlapping relationship with a pair of corresponding ones of the pages and with the band positioned in overlying relationship with the spine and the top, front and bottom edge surfaces of the publication to thereby provide a sealed portion of the publication which cannot be examined without leaving an indication that the band has been broken or otherwise tampered with.

2. A publication protector according to claim 1 wherein the front face, back face and band are made of nonstretchable flexible material.

3. A publication protector according to claim 1 wherein a portion of the band is integrally formed with the spine of the publication.

4. A publication protector according to claim 1 wherein the attaching means includes a plurality of tabs which extend substantially perpendicularly from the faces and overlap the top, front and bottom edge surfaces of the publication beneath the band, and a quantity of adhesive that bonds a portion of the band to the tabs.

5. A publication protector according to claim 3 wherein the tabs are integrally formed with respective ones of the front and back faces.

6. A publication protector according to claim 1 wherein the band has a pair of end portions which terminate adjacent to each other but spaced apart to define a gap therebetween.

* * * * *